United States Patent [19]

Ziemba

[11] 3,999,718

[45] Dec. 28, 1976

[54] SPIRAL ACCUMULATOR FOR A FLEXIBLE METAL STRIP

[75] Inventor: Francois Ziemba, St. leu D'Esserent, France

[73] Assignee: Societe de Constructions Mecaniques de Creil-Comec, Creil, France

[22] Filed: July 28, 1975

[21] Appl. No.: 599,779

[30] Foreign Application Priority Data

Aug. 2, 1974 France ..... 74.26930

[52] U.S. Cl. ..... 242/55; 72/146; 242/55.19 R

[51] Int. Cl.[2] ..... B65H 75/02; B21C 47/02

[58] Field of Search ..... 72/146, 147, 227, 230, 72/231, 280; 242/55, 55.18, 55.19 R, 55.19 A

[56] References Cited

UNITED STATES PATENTS

| | | | |
|---|---|---|---|
| 1,186,924 | 6/1916 | McNeel | 242/55.18 |
| 1,320,818 | 11/1919 | Youngblood | 242/55.18 |
| 2,255,724 | 9/1941 | Sunell | 242/55.18 |
| 2,781,689 | 2/1957 | Heyer | 242/55.19 R |
| 3,013,738 | 12/1961 | Jones | 242/55.19 R |
| 3,034,399 | 5/1962 | Goepel | 242/55.19 R |
| 3,341,139 | 9/1967 | LaTour | 242/55.19 R |
| 3,506,210 | 4/1970 | LaTour | 242/55.19 R |

FOREIGN PATENTS OR APPLICATIONS

| | | | |
|---|---|---|---|
| 608,977 | 11/1960 | Canada | 242/55.18 |
| 340,002 | 8/1921 | Germany | 242/55.19 R |

*Primary Examiner*—C.W. Lanham
*Assistant Examiner*—E. M. Combs
*Attorney, Agent, or Firm*—Browdy and Neimark

[57] ABSTRACT

An accumulator for a flexible metal strip has a rotatable annular plate for supporting spiral wound turns of the strip and an outer and inner crown of rollers disposed at the outer and inner peripheries thereof. A deflecting device is disposed inside the inner crown of rollers to guide the inner turn of the strip out of the accumulator and over the spiral wound turns of the strip. The deflecting device has a series of rollers with fixed axes which are tilted with respect to the plate axis at varying angles which preferably increase directly with decreasing distance from the accumulator outlet. The intersections of the axes of the deflecting rollers with the plane are preferably on a circle having an axis displaced with respect to the plane axis and the projections of the deflecting roller axes on the plate plane preferably form a constant angle with the tangents of the circle at each of these intersections.

9 Claims, 7 Drawing Figures

14
3
28b
21
IV
10
5
29
28a
VI
1
VII
6
128
27
26
23
3a
20a
20
3b
4

SPIRAL ACCUMULATOR FOR A FLEXIBLE METAL STRIP

FIELD OF THE INVENTION

The present invention relates to spiral accumulators for flexible metal strips and more particularly to improvements on deflecting devices for such accumulators.

BACKGROUND OF THE INVENTION

It is known that spiral accumulators are temporary storage devices incorporated in a processing or transformation line, such as a shaping line, enabling a tube to be obtained from a length of metal strip. The accumulator contains a number of spiral-wound turns of the strip. These turns form a reserve which, particularly when a supply spool is exhausted, permits a new spool to be butt-joined while the line continues to be supplied by the reserve in the accumulator.

In known machines of this type the turns of strip are supported by a horizontal plate. Accordingly, to supply the line downstream, the inside turn must be caused to pass above the spiral-wound turns. This deflecting device must thus be mounted inside the spiral to guide the inside turn, and must prevent differences in tension from being created between its lower and upper edges. Such differences of tension would cause the lengths of the two edges to be different such that the edge stretched the most would crinkle. The latter is unacceptable if, for example, it is desired to weld the strip edge to edge to form a tube.

A spiral accumulator including a positively rotatable annular plate with a vertical axis is known. An inner crown and outer crown of rollers loosely mounted with respect to fixed vertical axes are disposed respectively at the inside periphery and the outside periphery of the plate to contain the turns of the strip. The deflecting device is composed of a central drum disposed inside the inner circle of rollers and freely rotatably mounted with respect to an axis tilted relative to the vertical axis of the plate.

This deflecting device, due to the inclination of its axis with respect to the vertical, guides the inside turn to some extent, making it pass above the other turns. But it will be seen that during this deflection the inside turn of the strip would not of itself assume a shape such that it can be applied to a cylinder. Thus, a cylindrical deflecting device, even with a tilted axis, is not the ideal guide for preventing differential lengthening of the strip.

SUMMARY OF THE INVENTION

The particular purpose of the present invention is to design an improved deflecting device preventing differential lengthening of the strip and at the same time being simple in form and not costly.

According to the present invention, the spiral accumulator includes a rotatable annular plate with a substantially vertical axis mounted on a fixed frame and designed to support the turns of the spiral-wound strip and means for rotating this plate. An outer and an inner crown of rollers are loosely mounted with respect to their fixed and substantially vertical axes, disposed respectively at the outer and inner periphery of the plate to restrain the turns of strip. A deflecting device is disposed inside the inner crown of rollers to guide the inner turn of the strip to the accumulator outlet, causing it to pass over the spiral-wound turns of strip. This deflecting device is characterized by including a series of rollers loosely mounted with respect to their axes which are fixed with respect to the said frame, these axes being tilted with respect to the plate axis at angles varying from one roller to another.

Thus, by appropriately adjusting the respective inclinations of the axes of the deflecting rollers, the inside turn of the strip can be guided along a surface corresponding to a homogenous distribution of the tensions in the strip. These differently tilted rollers constitute a simple and economic means of producing a geometrically complex surface.

According to a preferred embodiment of the present invention, the inclination of the axes of the deflecting rollers increases progressively from one roller to the next with increasing proximity of the rollers to the accumulator outlet and with decreasing distance between the rollers and the outlet of the accumulator. The lower ends of these axes, situated on the plate side, are disposed substantially on an arc of a circle whose center is located a certain distance from the plate axis, on the side opposite the accumulator outlet with respect to this axis. On the other hand, the projections in the plane of the plate of the axes of the deflecting rollers make substantially equal angles with the tangents to the above-mentioned circle at the points where this circle intersects each of these axes.

The deflecting device is advantageously supplemented by an outlet guide which has at least two adjacent rollers whose axes are parallel to each other and tilted with respect to the plate axis, one of said rollers being positively rotatable. The bases of these outlet rollers are disposed a certain distance above the plane of the plate and support rollers with substantially horizontal axes are disposed in the vicinity of the deflecting rollers to support the inside turn of the strip, the distance of these rollers from the plane of the plate increasing inversely with the distance from the outlet of the accumulator. Thus, the inside turn of the strip is not only applied to a suitable surface, but its lower edge is also guided along an appropriate path.

Other characteristics and advantages of the invention will emerge from the detailed description hereinbelow.

BRIEF DESCRIPTION OF THE DRAWINGS

In the attached drawings, shown as non-limitative examples, a preferred embodiment of the invention is shown.

DETAILED DESCRIPTION OF A PREFERRED EMBODIMENT

Figure 1:
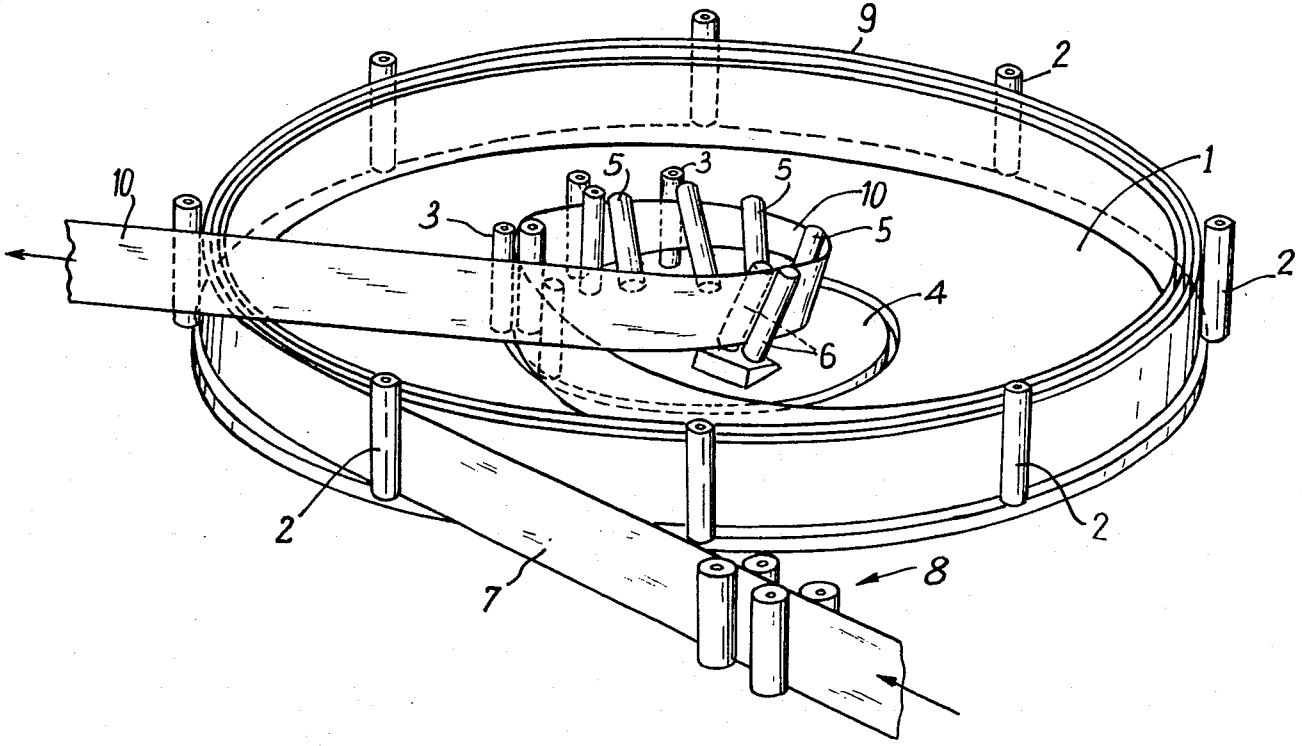
FIG. 1 is a schematic perspective view of a accumulator according to the invention.
Figure 2:
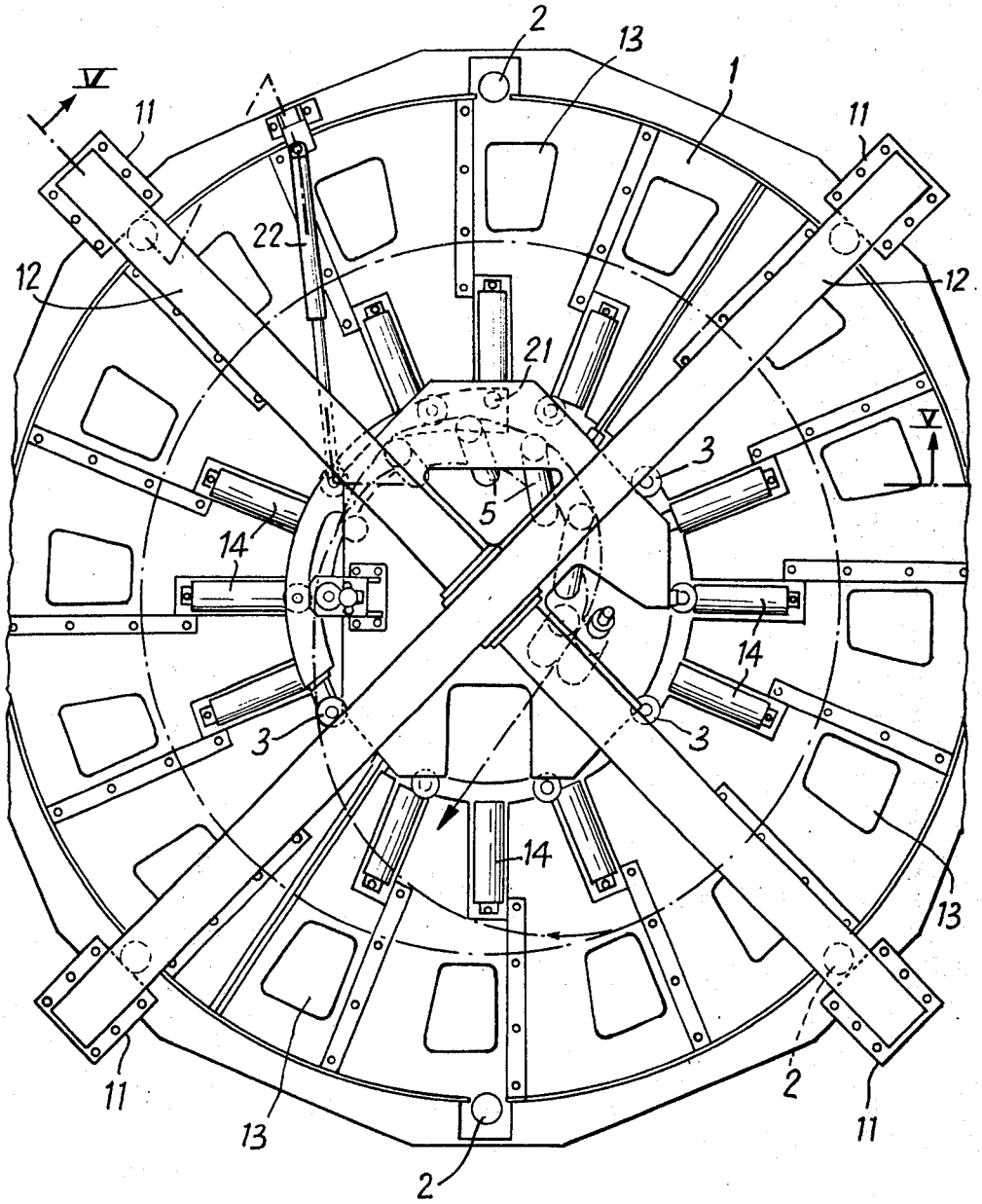
FIG. 2 is a plane view of a particular embodiment of the invention.

FIG. 1 shows schematically the essential parts of a spiral accumulator according to the invention. This includes an annular plate 1 driven about a substantially vertical axis. An outer crown of rollers 2 is disposed at the outer periphery of plate 1; an inner crown of rollers 3, only partly shown with a view to clarity, is located at the inner periphery of this plate. Rollers 2 and 3 are loosely mounted with respect to the fixed vertical axes. A fixed hub 4 which supports a deflecting device including rollers 5 loosely mounted with respect to axes tilted with respect to the vertical is disposed inside inner crown of rollers 3. A guide which includes two adjacent rollers 6 with axes tilted with respect to the vertical, one of which is positively rotatable, is disposed at the outlet of this device.

Flexible metal strip 7, after entering feed guide 8, which is not part of the invention, traverses the inner crown of rollers 2 and is wound to form a coil 9 on rotary plate 1 between outer rollers 2 and inner rollers 3. Inside turn 10 traverses inside crown of rollers 3 and is deflected by inclined rollers 5 and rollers 6 of the outlet guide so as to exit from the accumulator passing above coil 9.

In the embodiment shown in FIGS. 2 to 7, the accumulator includes a fixed frame which essentially comprises peripheral pillars 11 supporting two crosspieces 12.

Annular plate 1 is lightened by a series of notches 13 (FIG. 2) and is provided on the inside with a series of holding rollers 14 mounted loosely with respect to the radial axes and regularly distributed along the inner periphery of the plate. The purpose of these rollers is to facilitate the sliding of the turns of strip with respect to the plate. Plate 1 is rotated by an electric motor 15 (FIG. 4) through a gearbox 16 which drives a pinion 17 meshing with a crown 18 made integral with plate 1. Crown 18 is supported on the frame of fixed hub 4 by means of a ball bearing 19.

Figure 3:
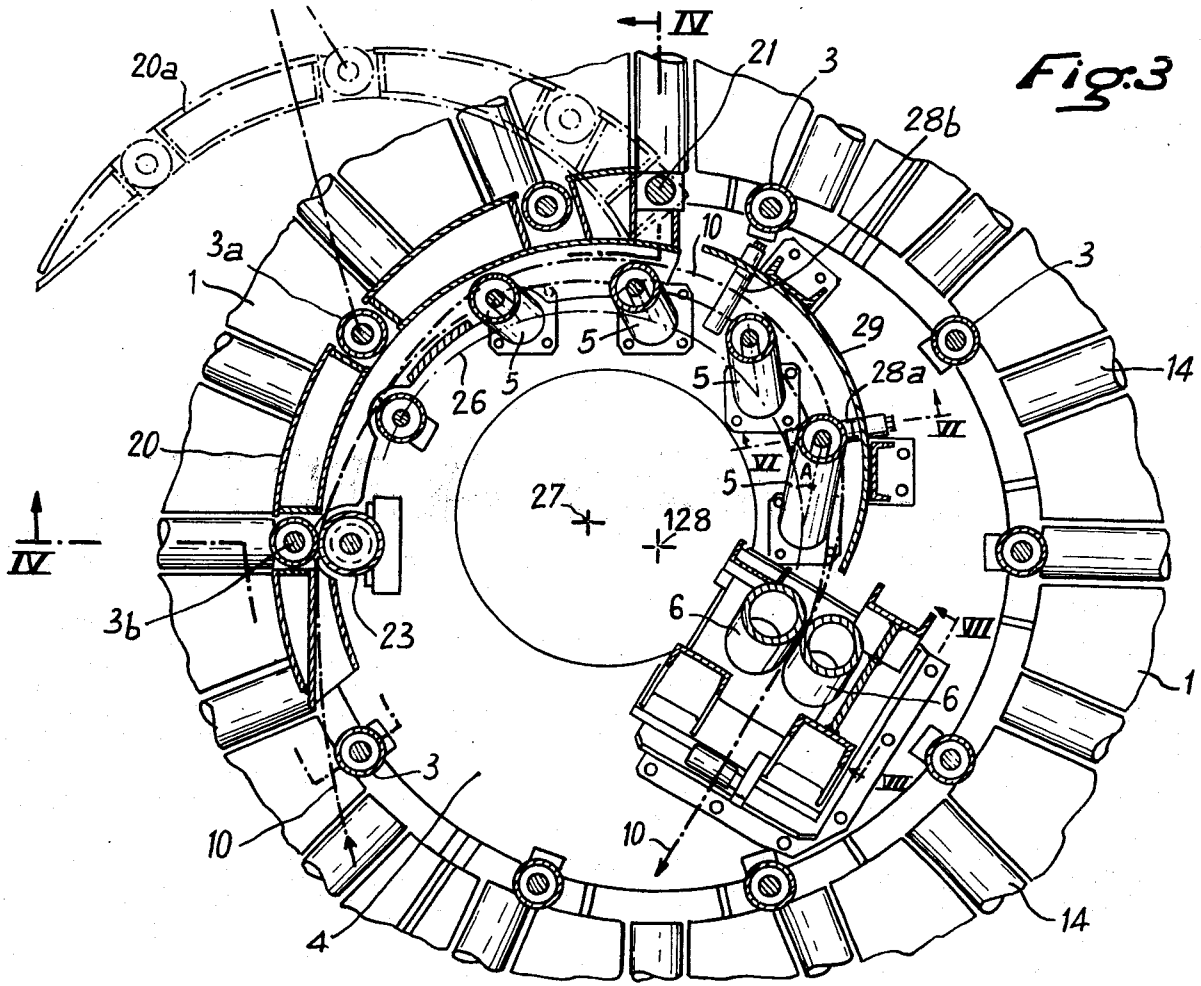
FIG. 3 is a partial view in a section perpendicular to the axis of the plate of the design shown in FIG. 2.
Figure 4:
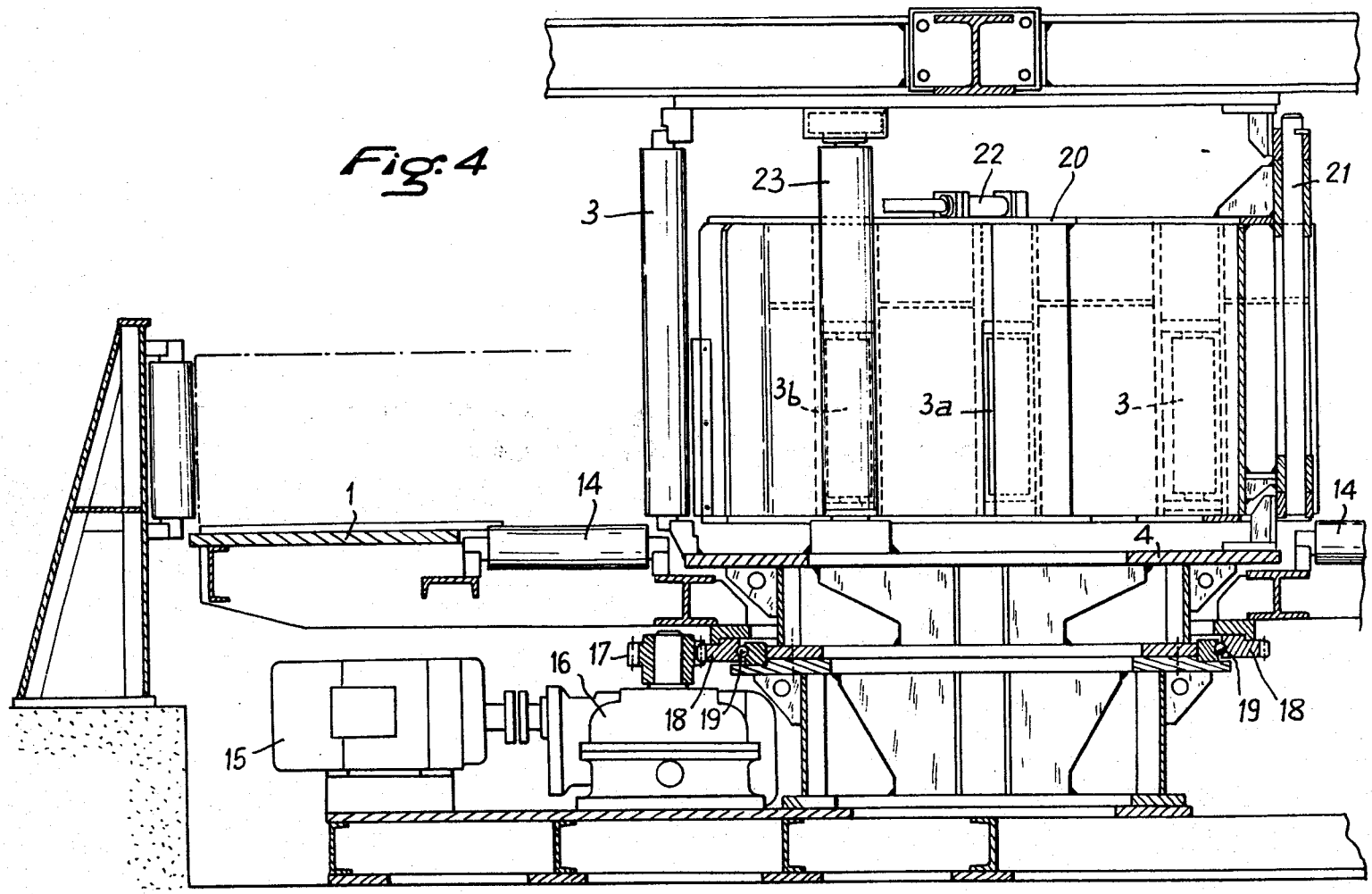
FIG. 4 is a section along line IV—IV of FIG. 3.
Figure 5:
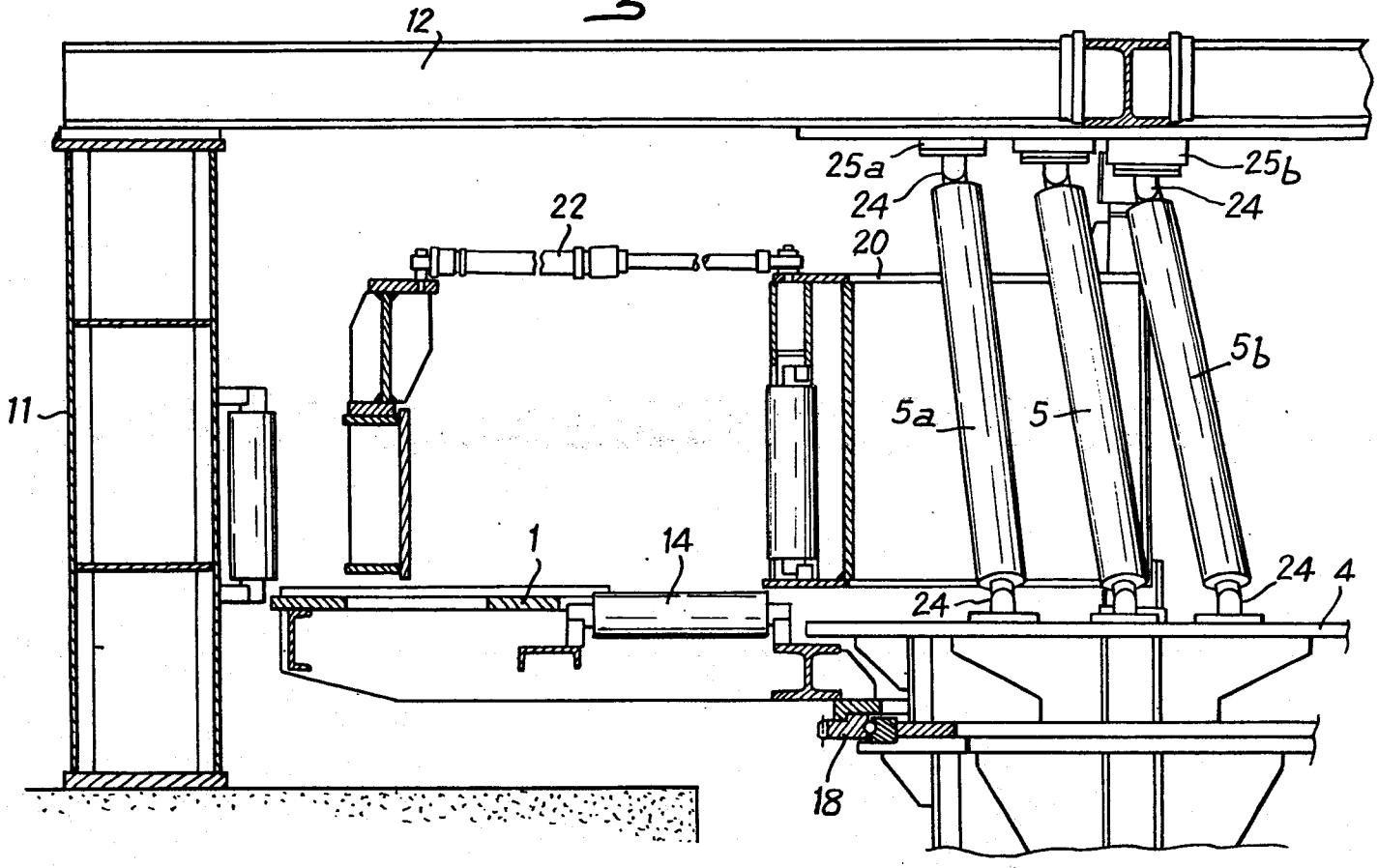
FIG. 5 is a section along line V—V of FIG. 2.

The inside crown of rollers 3 includes a moving section 20 visible on FIGS. 3, 4 and 5 which is articulated on a vertical shaft 21 and can pivot around this shaft under the influence of a hydraulic jack 22 whose body is fixed to the frame of the outside roller crown 2 and whose shaft is articulated on the axis of a roller **3*a* which is part of moving section 20. This section is in the normal position as shown in solid lines in FIG. 3 and completes the inside crown of rollers. Under the influence of jack 22 this section can be brought into position 20*a* as shown in dotted lines in FIG. 3,** which enables the end of the metal strip to be easily fitted into the deflecting device, traversing the inside crown of rollers. This system is particularly advantageous when the strip is thick and therefore extremely rigid.

Roller **3*b* disposed at the end of moving section 20 is adjacent to a roller 23 of greater diameter which is rotated positively by means of a hydraulic motor (not shown). The set of rollers 3*b* plus 23** forms a guide for the strip to cross the inside crown of rollers.

The axes of deflecting rollers 5 are connected on the one hand to fixed hub 4 and on the other to the frame of the accumulator by ball joints 24 (FIG. 5). Wedges 25, the thickness of which varies from one deflecting roller to the other, which enables different inclinations for the different rollers to be obtained with rollers similar to each other, are located between the upper ends of these axes and the upper part of the frame of the accumulator.

The inclination of the axes of the deflecting rollers 5 with respect to the axis of the plate, namely with respect to the vertical, increases progressively from one roller to another with increasing proximity to the accumulator outlet. This is especially obvious in FIGS. 3 and 5. One can see from the latter figure that wedge **25*a* is less thick than wedge 25*b*, so that roller 5*b* slopes more than roller 5*a*.**

The lower ends of the axes of deflecting rollers 5, connected to hub 4, are disposed substantially in an arc of a circle 26 (FIG. 3), the center 27 of which is shifted with respect to axis 128 of the plate, on the side opposite the accumulator outlet. In addition, the projections on the plane of the plate of the axes of the deflecting rollers make substantially equal angles A with the tangents to circle 26 at the intersections of this circle with the axes of the deflecting rollers.

Figure 7:
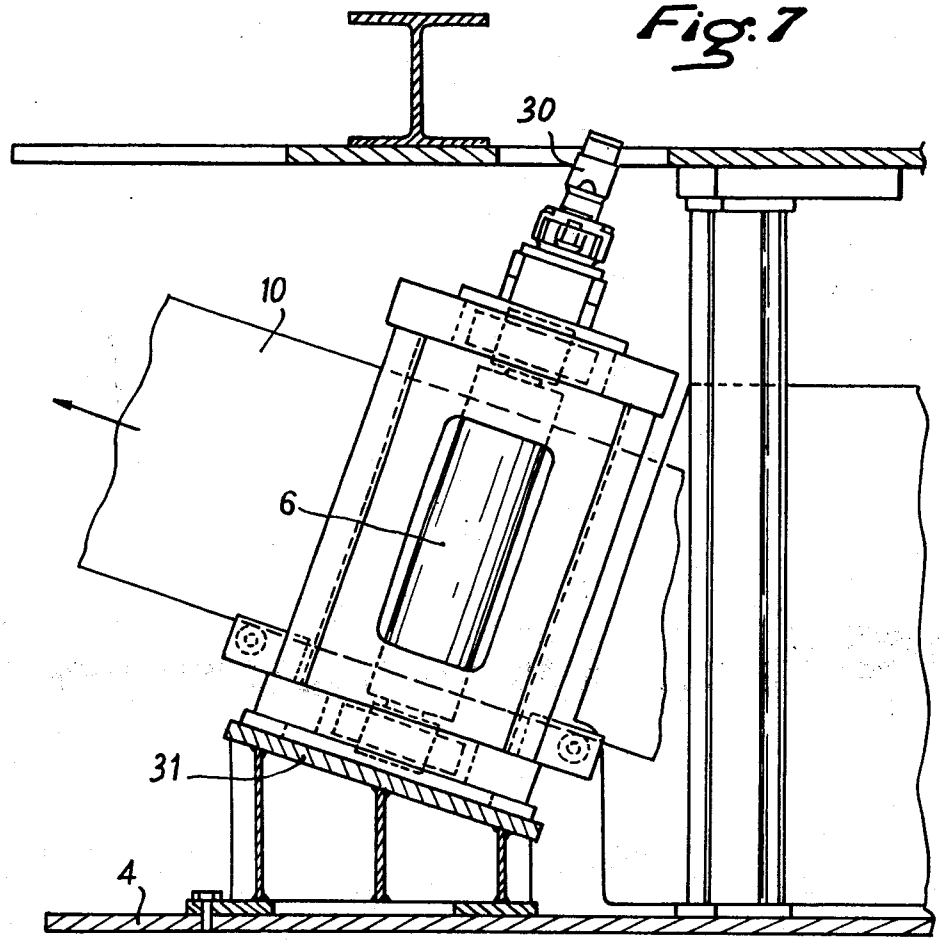
FIG. 7 is a partial view along line VII—VII of FIG. 3.
Figure 6:
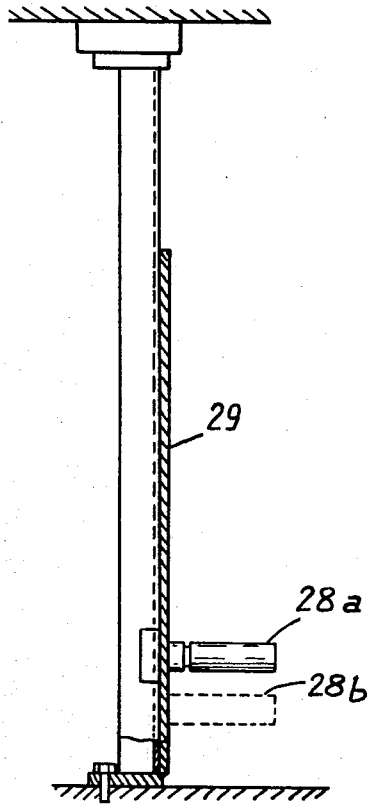
FIG. 6 is a partial view of a section along line VI—VI of FIG. 3.

Support rollers 28 (FIGS. 3 and 6), mounted loosely with respect to the horizontal axes are disposed in the vicinity of deflecting rollers 5 and supported by a support 29 mounted on fixed hub 4. The vertical distance between the axes of these rollers 28 and the plane of the plate increases with proximity to the accumulator outlet, as seen from FIG. 6 wherein roller **28*a* is nearer to the outlet than roller 28*b*. The outgoing guide is mounted downstream of the deflecting device, with respect to the feed direction of the strips; said guide comprises two adjacent rollers 6, with axes tilted with respect to the vertical, one of which is rotated by a motor 30 (FIG. 7). This guide is mounted on support 31 tilted with respect to fixed hub 4 such that the vertical distance between the bases of rollers 6 and the plane of plate 1 is greater than the vertical distance between the last support roller 28*a*** and this plane.

Thus, the inside turn 10 of the strip has its lower edge guided by support rollers 28 along a helicoidal path while the surface of the turn is tangential to each of deflecting rollers 5 whose respective inclinations are governed such that the strip assumes a shape (shown in FIG. 3) of the helicoidal type, calculated such that the internal tensions in this strip are homogeneously distributed to avoid differences of stretching between the two edges. By varying the number and respective inclinations of deflecting rollers 5 and the number and positions of support rollers 28, it will be understood that guidance of the inside turn of the strip can be made as close to ideal as is desired.

Of course, the invention is not limited to the embodiment described hereinabove to which may be brought numerous variations of implementation within the reach of the expert, without departing from the scope of the invention.

What is claimed is:

1. In a spiral accumulator for a flexible metal strip comprising:

a fixed frame;

an annular plate with a substantially vertical axis, rotatably mounted with respect to said fixed frame for supporting the spiral-wound turns of the strip;

rotating means for rotating said annular plate;

an outer and an inner crown of rollers each roller freely rotatably mounted with respect to its fixed and substantially vertical axis, said outer and inner crowns of rollers being disposed respectively at the external and internal peripheries of said annular plate for retaining the turns of the strip; and deflecting means disposed within said inner crown of rollers for guiding the inside turn of the strip to the outlet of the accumulator, causing it to pass above the spiral wound turns of the strip, the improvement wherein said deflecting means includes a series of deflecting rollers freely rotatably mounted with respect to the axes thereof, said axes of said deflecting rollers being fixed with respect to said frame and being tilted with respect to the axis of said annular plate by an angle varying from one deflecting roller to another, and wherein the intersections of the lower ends of the axes of the deflecting rollers with the plane of said annular plate are disposed substantially in an arc of a circle whose center is situated at a certain distance from the axis of said annular plate, on the side of the axis of said annular plate opposite that of the accumulator outlet.

2. An accumulator in accordance with claim 1 wherein the inclination of the axes of said deflecting rollers increases progressively from one deflecting roller to the next according to the proximity of the rollers to the accumulator outlet.

3. An accumulator in accordance with claim 1, wherein the projections of the axes of said deflecting rollers on the plane of said annular plate make substantially equal angles with the tangents of said circle at the points where said circle intersects each of these axes.

4. An accumulator in accordance with claim 1 further including an outgoing guide disposed after said deflecting rollers in the strip feed direction, said guide comprising at least two adjacent guide rollers whose axes are parallel to each other and tilted with respect to the axis of said annular plate, one of said guide rollers being positively rotated.

5. An accumulator in accordance with claim 4, wherein the bases of the outgoing guide rollers are disposed at a certain distance above the level of the plane of said annular plate.

6. An accumulator in accordance with claim 1 wherein the axes of the deflecting rollers are connected at their two ends to said frame by ball-and-socket joints.

7. An accumulator in accordance with claim 1 wherein said inner crown of vertical rollers includes a section articulated about a fixed and substantially vertical axis and means for making said section pivot about the axis thereof to permit the introduction of the inside turn of the strip into said deflecting means.

8. An accumulator in accordance with claim 1 wherein said deflecting means further includes support rollers with substantially horizontal axes disposed in the vicinity of said deflecting rollers for supporting the inside turn of the strip.

9. An accumulator in accordance with claim 8 wherein the vertical distance of said support rollers from the plane of said annular plate increases inversely with the distance from the accumulator outlet.

* * * * *